US005129130A

United States Patent [19]

Lecouturier

[11] Patent Number: 5,129,130

[45] Date of Patent: Jul. 14, 1992

[54] SHOE LACE ARRANGEMENT WITH FASTENER

[76] Inventor: Jacques Lecouturier, 350 Holly Dr., San Rafael, Calif. 94903

[21] Appl. No.: 702,412

[22] Filed: May 20, 1991

[51] Int. Cl.[5] ..... A43C 7/00

[52] U.S. Cl. ..... 24/712; 24/712.6; 24/713.2

[58] Field of Search ..... 24/712, 712.6, 713.2, 24/713.9, 714, 714.6, 69 R, 69 SK, 71 SK

[56] References Cited

U.S. PATENT DOCUMENTS

| | | | |
|---|---|---|---|
| 470,183 | 3/1892 | Dorr . | |
| 889,770 | 6/1908 | Dorothy . | |
| 1,088,316 | 2/1914 | Ayres | 24/69 SK |
| 1,995,243 | 3/1935 | Clarke . | |
| 2,861,310 | 11/1958 | Martin | 24/712.6 |
| 3,057,029 | 10/1962 | Miller, Jr. et al. | 24/712.6 |
| 2703074,261, | 4/1981 | Lott . | |
| 3,225,402 | 12/1965 | Altman et al. | 24/712.6 |
| 4,083,130 | 4/1978 | Bertetto et al. | 24/69 SK |
| 4,253,217 | 3/1981 | Marzocchi | 24/71 SK |
| 4,999,889 | 3/1991 | LeCouturer | 24/713.2 |

*Primary Examiner*—Victor N. Sakran

[57] ABSTRACT

A shoe lace arrangement having a fastener (10), goes from a hole attachment (22) on one flap of the shoe to a groove (12) on lever (11) on the opposite flap. The lever rotates an oblong pin (27) inside a stationary oblong aperture (26). In the lever closed position, the pointed portion of oblong pin (27) becomes engaged in the oblong portion of aperture (26) locking the lever in its closed position. Upward pull on the lever dislodges the aperture (26) from its locked position. The lace is disengaged from grove 12 to widely open the shoe frontal opening (18).

2 Claims, 1 Drawing Sheet

SHOE LACE ARRANGEMENT WITH FASTENER

FIELD OF THE INVENTION

This invention relates to a shoe lace arrangement allowing for an expedient insert and removal of the foot and having a selflocking fastener to replace the bow knots.

BACKGROUND OF THE INVENTION, PRIOR ART

In the lace arrangement of the type used in this invention the lace is held on one flap of the shoe frontal opening through holes and retained on the opposite flap around grooves. By disengaging the lace from the grooves, the shoe frontal opening is no longer restricted by the lace.

In Dorr U.S. Pat. No. 470,183 of 03/08/1892 the lace goes from twin eyelets on one flap to hooks on the opposite flap for the purpose of overlapping the margins of the flaps. Dorr's lace arrangement is tied by a bow knot.

In Dorothy U.S. Pat. No. 889,770 of 06/02/1908 a series of spring loaded fasteners along both flaps, tension the lace across the margins. The lace can be disengaged from the fasteners to remove the shoe without having to un-tie the bow knots.

In Clarke U.S. Pat. No. 1,995,243 of 03/19/1935, the lace goes from a raised eyelet on one margin to a raised hook on the opposite margin in a number of patterns. Clarke uses bow knots.

In Martin U.S. Pat. No. 3,491,465 of 01/27/1970, the lace arrangement is tightened by fasteners of the type implemented in Martin U.S. Pat. No. 2,861,310 of 11/25/1958. This type of fastener lacks a locking mechanism and would not be reliable on a shoe with a soft shoe upper.

In Lecouturier U.S. Pat. No. 4,999,889 granted 3/19/91, a hinged fastener, added to the lace arrangement, tightens the lace along the shoe frontal opening and provides a locking mechanism different from the present invention.

In recent years, several improvements have been introduced in the market place to remedy some of the drawbacks of the conventional lace and bow knots.

VELCRO (Trade mark) aims at replacing the lace in part or entirely. However, it cannot distribute tension the way lace does; it does not perform when dirty; it is not durable; it cannot be replaced when it is worn out.

A device of the type improved by Lott U.S. Pat. No. 4.261,081 of 04/14/1981 eliminates the bow knots but restricts the opening of the shoe frontal opening.

Another device found in stores is limited to holding the tension in the lace prior to making the bow knots.

These improvements for a suitable substitute to the bow knots and/or the lace, illustrate the need to redesign shoes equipped with long laces, more specifically athletic shoes, allowing for the convenience of a fastener.

OBJECT AND ADVANTAGE OF THE INVENTION

The lace arrangement and fastener eliminates the bow knots. At the same time, it improves the operation of widening the shoe throat to step in and out.

Installing and tightening the lace across the shoe frontal opening is made faster and more convenient than with conventional lacing and bow knots. If required by circumstances, the lace can now be installed and tightened with one hand. More pull can now be applied on the lace to maximize lace tension. The lace tension is distributed over the entire frontal section and creates no pressure points.

The fastener's lever establishes and locks the lace tension. The lock of the fastener increases as the tension in the lace increases precluding accidental release of the fastener.

The lace is secured on the lever of the fastener by a lace attachment facing away from the shoe upper, preventing accidental disengagement of the lace from the fastener, under lapse of tension in the lace.

A flip of the fastener leads to a quick opening of the shoe throat and an expedient removal of the foot.

A lever with several grooves provides various tension levels in the lace arrangement. A slack adjustment incorporated in the lace circuit enables a broader variation of tension levels.

The lace arrangement and fastener do not alter or distract the appearance of the shoe. The fastener is small and discreet. The improvement does not increase the shoe cost significantly.

| DESCRIPTION REFERENCES AND NUMERALS | |
|---|---|
| 10. Fastener | 11. Lever of fastener |
| 12. Groove attachment | 13. Hinge of fastener |
| 14. Fastener supporting plate | 15. Pin holding flanges |
| 16. Oblong rotating aperture | 17. Oblong stationary pin |
| 18. Shoe frontal opening | 19. Any shoe flap |
| 20. Any margin of shoe flap | 21. Ridge on lever |
| 22. Twin hole attachment | 23. Slack adjustment |
| 24. Hole attachment | 25. Aperture holding flange |
| 26. Oblong stationary aperture | 27. Oblong rotating pin |
| 28. Lace loop to fastener | 29. Upper lace end lock |
| 30. Lower lace end lock | |

DESCRIPTION OF THE INVENTION

Figure 1:
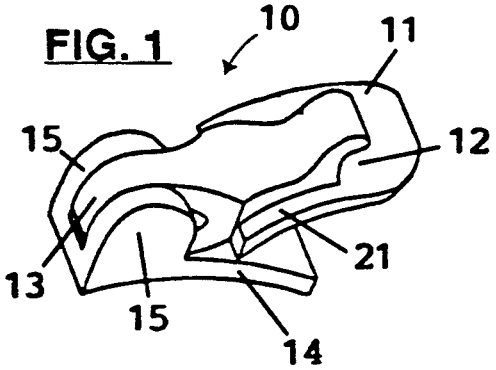
FIG. 1 shows a perspective view of fastener 10.
Figure 2:
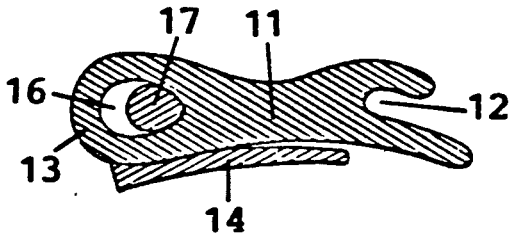
FIG. 2 shows a vertical section of the fastener, in the middle of its longitudinal dimension, when lever 11 is in its closed position.

A supporting plate 14 FIG. 1, perpendicularly to its plane, holds two flanges 15 on each side of hinge 13 of fastener 10. A lever 11 holds a lace attachment 12. At the fulcrum of hinge 13 and across flanges 15 is stationary pin 17, FIG. 2. With lever 11 in a closed position, FIG. 2 shows a cross section of the fastener. A pointed portion of stationary oblong pin 17 conforms with a pointed portion of a rotating oblong aperture 16 integral with lever 11 and inside hinge 13. In lever 11 open position, FIG. 3, rounded portion of oblong aperture 16 turns against stationary oblong pin 17.

Figure 4:
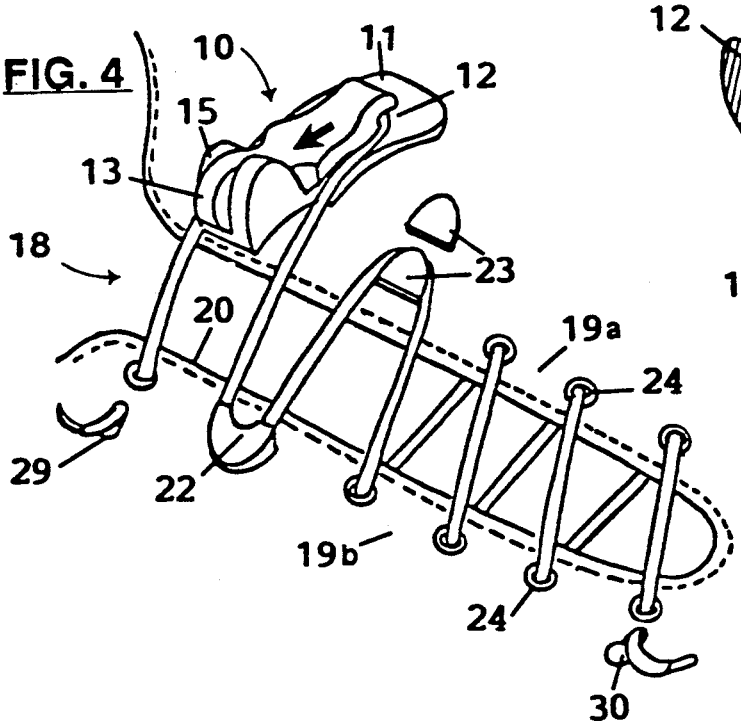
FIG. 4 shows a schematic view of the closed lace arrangement along margin 20 of shoe frontal opening 18.

The lace serpentines from an upper lace end lock 29 to a lower lace end lock 30 between flaps 19a and 19b FIG. 4. The lace goes in and out of hole attachments 24 and twin holes 22, around groove 12. Upper lace end lock 29 and lower lace end lock 30 tie the two ends of the lace to the shoe upper.

Figure 5:
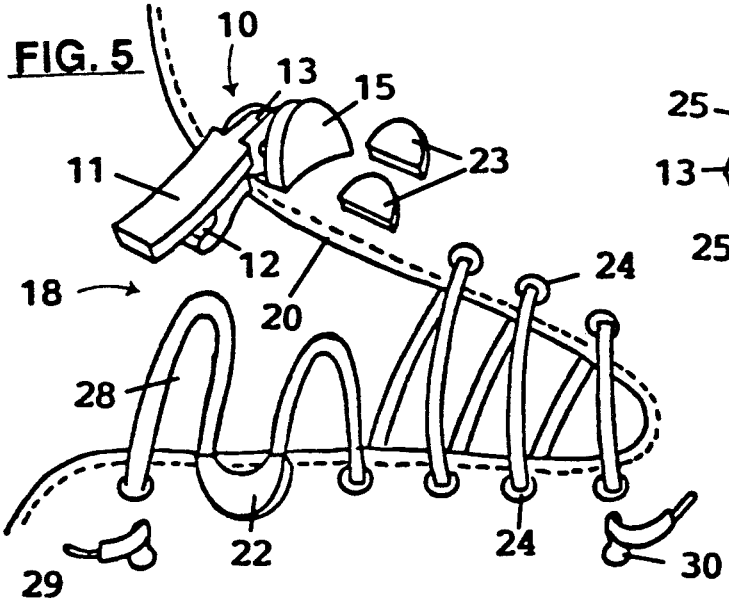
FIG. 5 shows a schematic view of the open lace arrangement after the lace is disengaged from groove attachments 12 and 23.

The opening of lever 11 provides lace slack in a loop 28 to open the shoe FIG. 5. To increase the size of loop 28, the fastener can be mounted further away from margin 20.

In an alternate configuration, a slack adjustment 23 provides additional slack to further widen the shoe frontal opening.

Figure 6:
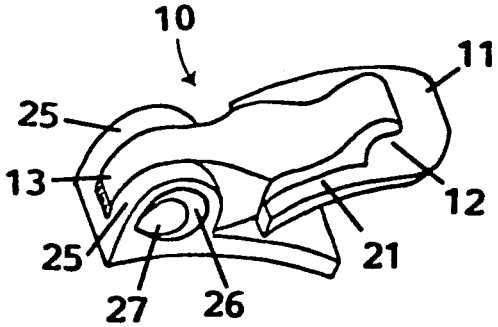
FIG. 6 shows an alternate embodiment of ablong pin 27 engaged in ablong aperture 26.

The pin and aperture lock can be inter-changed as in FIG. 6. Here, an ablong pin 27 is now mounted at the fulcrum and rotates with lever 11. An ablong aperture 26 is stationary and mounted on flanges 25. Oblong pin 27 rotates inside stationary oblong aperture 26.

A ridge 21 on lever 11 FIG. 1 AND 6 prevents the lace under tension to bank against the shoe upper should the length of the lever makes it necessary.

OPERATING THE INVENTION

When lever 11 is rotated downward to its closed position and the lace, engaged in groove 12, is subjected to tension, the lace tension pushes hinge 13 toward margin 20 FIG. 4 as shown with the arrow on lever 11. Pointed portion of oblong rotating aperture 16 of lever 11 in FIG. 2, is caused to press against pointed portion of oblong stationary pin 17 of hinge 13. Lever is locked in its position. Whenever tension in the lace increases, pointed portion of aperture 16 presses harder against pointed portion of pin 17, preventing the upward rotation of lever 11, and ensuring a stronger lock of lever 11.

Figure 3:
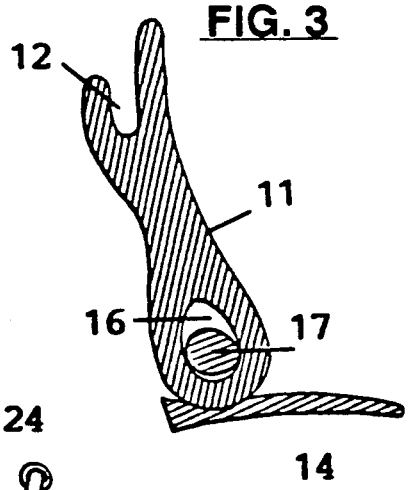
FIG. 3 shows a cross section of lever 11 in an upright position as relates to plate 14. Also shows a cross section of the respective position of oblong aperture 16 and ablong pin 17.

A steady upwardly rotating manual pull on lever 11 FIG. 3 in a motion away from margin 20 FIG. 4, disengages pointed portion of rotating aperture 16 from pointed portion of stationary oblong pin 17 FIG. 3. Upwardly rotated lever 11 allows the removal of lace loop 28 from groove 12 FIG. 5. A slack is now created in the lace circuit, allowing the subsequent lace disengagement from slack adjustment 23. The shoe is ready for a wide enlargement of its frontal opening 18 and an expedient stepping in an out of the shoe. Intermediary tension levels can be obtained by disengaging the lace from either groove 12 or slack adjustment 23.

The two ends of the lace are secured by lace end locks 29 and 30. The length of the lace circuit can be re-adjusted as the need arises.

In an alternate embodiment FIG. 6, oblong pin 27 rotates inside stationary oblong aperture 26. It is now pin 27 that presses against aperture 26 when lace is under tension.

SUMMARY OF THE INVENTION

Accordingly, the reader will see that the lace arrangement with a self-locking hinged fastener of this invention can be used effectively to tie and un-tie a lace without using bow knots, open and close a shoe frontal opening, improve the insertion and removal of the foot, create or alleviate tension in the lace.

Although the proceeding description contains many specificities, these should not be construed as limiting the scope of the invention but are only intended to show the possibilities of the invention.

For example:

a hole attachment can be placed on the lever and a groove attachment placed on the opposite flap.

the 2 flanges holding the pin for the hinge of the lever can be replaced by a single flange at the center of the hinge with an integral oblong pin protruding on each of the flange.

The scope of the invention is to be determined by the claims or the legal equivalents rathei than by the examples given.

I claim:

1. A shoe lace arrangement where the lace goes from a hole attachment means on one flap to a groove attachment means on the opposite flap; further comprises a hinged lace fastener having:

1) a rotating lever integral with a lace attachment means, 2) an aperture having an oblong cross section forming a pointed portion, at the fulcrum of said lever, 3) a plate with a vertical flange supporting a stationary pin having an oblong cross section forming a pointed portion, whereby said pointed portion of said pin when engaged into said pointed portion of said aperture by downward rotation of said lever, locks said lever in its closed position, and whereby said oblong aperture can be subsequently rotated against said oblong pin when said lever is steadily pulled upward to open said fastener.

2. A shoe lace arrangement where the lace goes from a hole attachment means on one flap to a groove attachment means on the opposite flap, and further comprising a hinged lace fastener having:

1) a rotating lever integral with a lace attachment means, 2) a pin having an oblong cross section forming a pointed portion, at the fulcrum of said lever, 3) a plate with a vertical flange supporting a stationary aperture having an oblong cross section forming a pointed portion, whereby said pointed portion of said pin when engaged into said pointed portion of said aperture by downward rotation of said lever, locks said lever in its closed position, and whereby said oblong pin can be subsequently rotated within said oblong aperture, when said lever is steadily pulled upward to open said fastener.

* * * * *